United States Patent [19]

Pelletier

[11] Patent Number: 4,974,320

[45] Date of Patent: Dec. 4, 1990

[54] ROTATABLE UTILITY KNIFE

[76] Inventor: Peter D. Pelletier, 1831 Franklin Ave. SE., Minneapolis, Minn. 55414

[21] Appl. No.: 371,918

[22] Filed: Jun. 27, 1989

[51] Int. Cl.[5] ..... B25F 3/00; B26B 3/06; B26B 9/02; B26B 11/00

[52] U.S. Cl. ..... 30/123; 30/162; 30/355; 7/158

[58] Field of Search ..... 30/123, 123.6, 358, 30/162, 355, 359, 351, 353; 7/158

[56] References Cited

U.S. PATENT DOCUMENTS

| | | | |
|---|---|---|---|
| 44,190 | 9/1854 | Hook . | |
| 580,287 | 4/1897 | Marsh . | |
| 1,321,215 | 11/1919 | Kollar | 30/355 |
| 1,528,615 | 3/1925 | Janecek . | |
| 1,535,816 | 4/1925 | Dabney . | |
| 1,828,621 | 10/1931 | Roberts . | |
| 1,990,967 | 2/1935 | Wenzel | 30/355 |
| 2,194,307 | 3/1940 | Jackson . | |
| 2,211,577 | 8/1940 | Muserlian . | |
| 2,568,353 | 9/1951 | Miseta . | |
| 2,677,180 | 5/1954 | Schierghofer . | |
| 2,952,025 | 9/1960 | Johnson | 30/123 |
| 3,107,426 | 10/1963 | Robinson . | |
| 3,286,351 | 11/1966 | McAlister . | |
| 4,068,375 | 1/1978 | Rathban et al. . | |
| 4,586,256 | 5/1986 | Weimann . | |
| 4,783,867 | 11/1988 | Tsao | 30/123 |
| 4,794,692 | 1/1989 | Wang | 30/123 |

*Primary Examiner*—Douglas D. Watts
*Assistant Examiner*—Paul M. Heyrana, Sr.
*Attorney, Agent, or Firm*—John A. Clifford

[57] ABSTRACT

An improved utility knife including a handle with a razor cutting blade end and a toothed cutting wheel end. An alternate embodiment includes a necked handle with a toothed cutting wheel affixed to a retractable arm which thereby allows the toothed cutting wheel to be retracted within the handle. A measuring device retention means is located near the toothed cutting wheel such that drywall can be measured and scored at the same time.

9 Claims, 2 Drawing Sheets

ROTATABLE UTILITY KNIFE

TECHNICAL FIELD

The present invention relates generally to the field of utility knives and in particular, a utility knife having a handle with a razor blade for general purpose cutting at one end of the handle and a toothed cutting wheel for scoring drywall at the other end of the handle.

BACKGROUND

Marking and cutting drywall is a common necessary step of many construction projects. Due to the rising cost of construction labor and tools, more convenient tools that can be operated more quickly and efficiently are always needed. The need for a convenient, simple and quick means of scoring and cutting drywall is apparent.

In the past, in order to mark and cut drywall, one needed to use a measuring device to measure the appropriate cutting distance and second, cut through the face paper and score the drywall core along the measured cutting distance. These two steps required the use of two independent and unrelated tools. This process necessitated carrying more tools, and it also required more time to carefully mark and cut drywall.

Prior art devices in this area include the device shown and described in U.S. Pat. No. 3,107,426, which discloses a utility knife device with a retractable razor blade. Other prior art discloses independent means for scoring drywall.

The present invention has significant advantages over those shown in the prior art. The present invention provides a means for attaching a measuring device above the toothed cutting wheel, such that the operator can hold the measuring device in one hand while operating the present invention in the other hand. This allows the operator to measure the cutting distance and score the drywall with the toothed cutting wheel of the present invention simultaneously. After the drywall has been scored, the board is snapped back and the toothed cutting wheel is then used to cut the face paper on the back side.

There are two main advantages of the present invention over those shown in prior art. First, the measuring device receiving means allows the operator to more quickly and accurately measure and score the drywall. Second, the convenience of housing a razor cutting blade and a toothed cutting blade in one device allows the operator to use the same device to score and cut the drywall. Thereby, the operator can quickly do the job with one device instead of two. The toothed cutting tool essentially eliminates the need for utility razor blades used in the drywall cutting procedure. In addition, since the toothed wheel is rolling as it cuts, cutting the drywall is much easier than using a non-rolling blade which creates friction and thereby becomes dull.

There are other advantages of the invention over the prior art that will become more apparent after reading the description and claims which follow.

SUMMARY OF THE INVENTION

The invention is an improved utility knife comprised of a handle and a blade receiving slot opening at one end of the handle. The handle has two elongated members which are detachably secured and separable along a longitudinal plane. A blade carrier reciprocally mounted on one of the elongated members of the handle provides for movement toward and away from the slot opening. A razor cutting blade is supported on the carrier. In addition, an elongated tongue rearwardly extends from the carrier for movement thereof. A locking cam on the surface of the handle defines a plurality of locking abutments for slotable reciprocating the carrier into and out of the utility knife's handle. The elongated handle also has a blade holder area within the elongated handle for the storage of blades. A toothed cutting wheel is affixed to the end of the elongated handle opposite to the blade receiving slot opening. Lastly, a measuring device receiving means used to engage the end of a measuring device with the toothed cutting wheel is at the end of the handle opposite to the blade receiving slot opening.

A second embodiment includes an improved utility knife having a blade receiving necked handle. The necked handle has a first and second end. The necked handle also has first and second axis with a first passageway located at the first end of the handle and a first slot located along the first axis of the necked handle. A second passageway is located at the second end of the handle and a second slot is located parallel to the second axis of the necked handle. Both the first and second slots pass through the outer wall of the necked handle. A first blade supporting arm is cooperatively engaged within the handle and is moveable between an outer position when the first arm extends through the first passageway. The first blade supporting arm is also movable to an inner position wherein the first arm is completely retracted within the handle. The first arm includes a blade retaining means on one end and a means for extending the first arm on the opposite end thereof. The means for extending the first arm include a first knob protruding through the first slot and slidable within the first slot as the first arm is moved from a outer position to an inner position. A toothed cutting wheel is affixed to the first wheel supporting arm by a pin means. A second blade supporting arm is cooperatively engaged within the handle and moveable between an outer position wherein the second arm extends through the second passageway. The second blade supporting arm also has an inner position wherein the second arm includes a second blade retaining means and a second means for extending the second arm through the second slot. The second blade supporting arm is slidable within the second slot as the second arm is moved from an outer position to an inner position. A trapezium shaped blade is affixed to the second blade supporting arm by a trapezium blade mounting means for mounting the blade on the second retractable blade supporting arm.

DETAILED DESCRIPTION OF THE INVENTION

Figure 1:
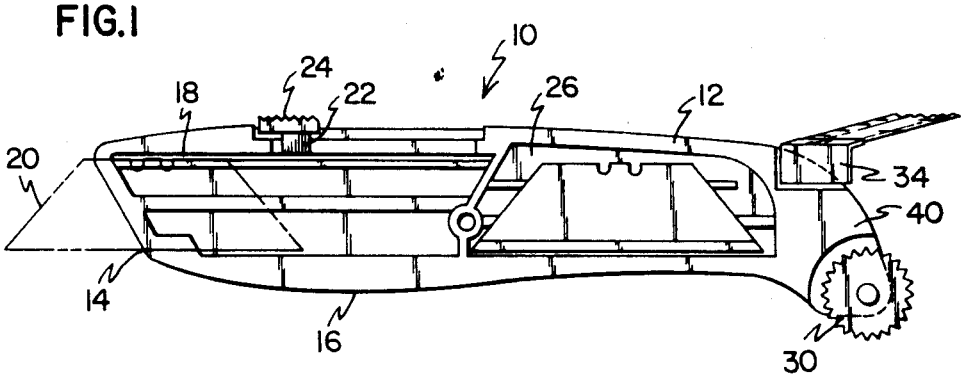
FIG. 1 is a side elevation view of the preferred embodiment with half of the knife handle removed.
Figure 2:
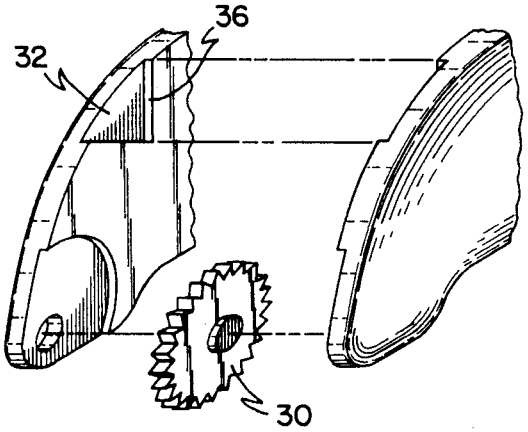
FIG. 2 is an enlarged perspective view of the toothed cutting wheel end of the preferred embodiment.
Figure 3:
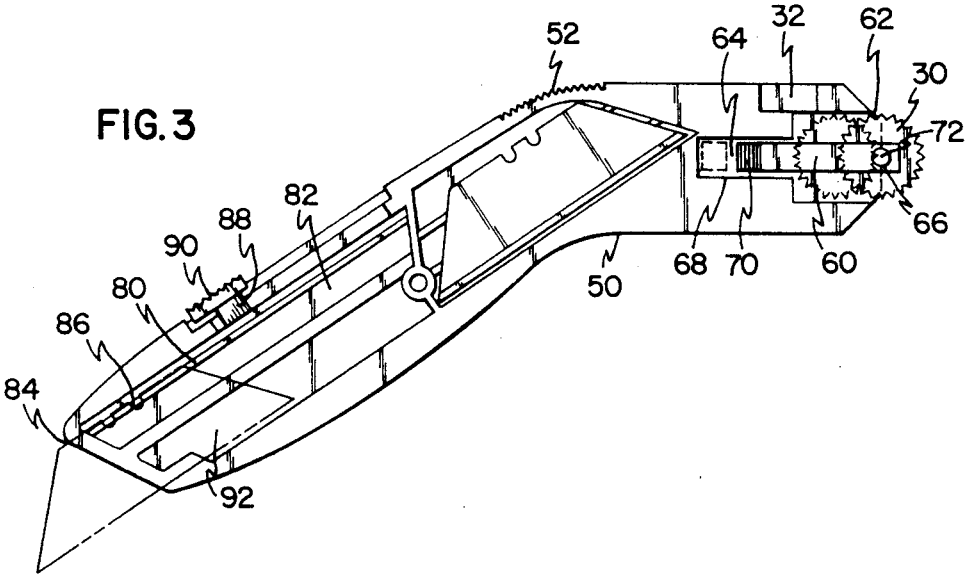
FIG. 3 is a side elevation view of a third embodiment with half of the handle removed.

Throughout the following description reference will be made to the drawings and the same numerals will be used throughout the several views to indicate the same or like parts of the invention.

Referring to the drawings more in detail. The utility knife of this invention generally denoted by the numeral 10 has an elongated handle 12 and a blade receiving slot opening 14 at one end thereof. The handle 12 has two elongated members 16 and 16', detachably secured and separable along a longitudinal plane. A carrier 18 is reciprocally mounted on one of the elongated members 16 for movement toward and away from the slot opening 14. A cutting blade 20 is supported on the carrier 18. An elongated tongue 22 rearwardly extends from the carrier 18 for movement thereof. In addition, a locking cam surface 24 is on the handle 12. The locking cam surface 24 defines a plurality of locking abutments for slideably reciprocating the carrier 18 within the handle 12.

A blade holder 26 is at the end of the elongated handle 12 opposite to the blade receiving slot opening 14. A toothed cutting wheel 30 is affixed to the end of the handle 12 opposite of the blade receiving slot opening 14. A measuring device receiving means 32 used for engaging receiving and an end of a measuring device 34 is substantially coplanar with the toothed cutting wheel 30.

The measuring device receiving means 32 is comprised of a flange 36 which is superposed to the toothed cutting wheel 30.

The utility knife 10 also includes a partition means 40 between the toothed cutting wheel 30 and the blade holder 26. The partition means 40 prevents the blades stored in the blade holder 26 from contacting the toothed cutting wheel 30.

Figure 4:
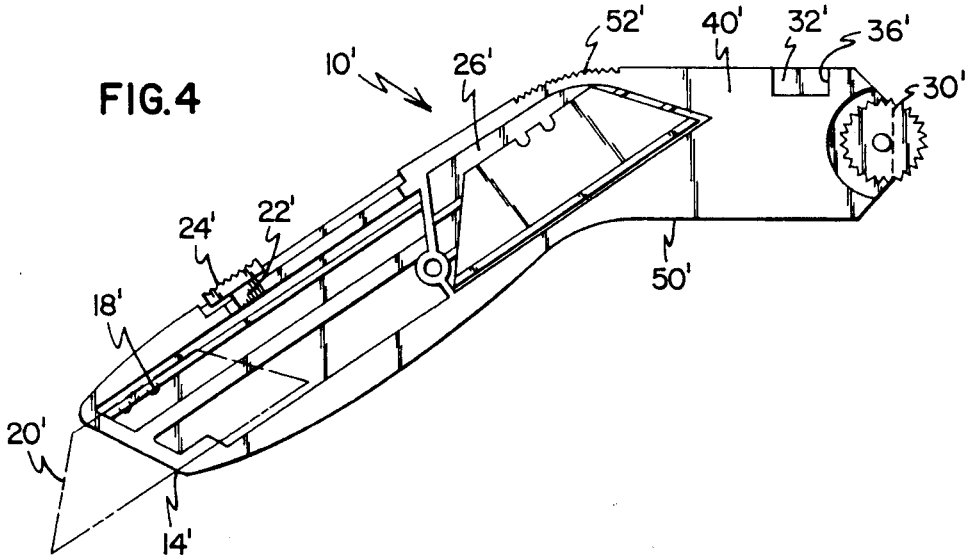
FIG. 4 is a side elevation view of a second embodiment with half of the handle removed.

A second embodiment illustrated in FIG. 4 includes an improved utility knife 10' comprised of a necked handle 50' and a blade receiving slot opening 14' at one end thereof. The handle has two elongated members which are detachably secured and separable along a longitudinal plane extended rearwardly from the slot openings 14'. In addition, a carrier 18' is reciprocally mounted on one of the elongated members for movement toward and away from the slot openings 14'. A cutting blade 20' is supported on the carrier 18' in an elongated tongue 22' which rearwardly extends from the carrier 18' for movement thereof. A locking cam surface 24' is also placed on the handle 50'. The locking cam surface 24' defines a plurality of locking abutments for slideably reciprocating the carrier 18' within the handle 50'.

A blade holder 26' is at the end of the necked handle 50' opposite to the blade receiving slot opening 14'. A toothed cutting wheel 30' is affixed to the end of the necked handle 50' opposite of the blade receiving slot opening 14'. A measuring device receiving means 32' used for engaging the end of a measuring device 34' is substantially coplanar with the toothed cutting wheel 30'. Flange 36' is superposed to the toothed cutting wheel 30' whereby an end 34' of a measuring device can be received. The measuring device may be a typical known metal tape measure or the like. FIG. 1 shows only a fragment of the tape measure. The flange 36' consists of corresponding notches 52' from the toothed cutting wheel end of each elongated member of the necked handle 50'. The notches 52' when juxtaposed thereby form the flange 36'. A partition means 40' lies between the toothed cutting wheel 30' and the blade holder 26'. The partition means 40' prevents the lade stored in the blade holder 26' from contacting the toothed cutting wheel 30'.

A third embodiment for an improved utility knife 10 includes a blade receiving necked handle 50 with an outer wall 54. The necked handle includes a first and second end which have a first and second axis. A first passageway 62 is located at the first end and the first slot 64 is located along the first axis and passes through the outer wall 54. A second passageway 82 is located at the second end and a second slot 84 is located parallel to the second axis and passes through the outer wall 54. A first supporting arm 60 is cooperatively engaged within the handle 50. The first wheel supporting arm 60 is moveable between an outer position wherein the first arm 60 extends through the first passageway 62 and an inner position wherein the first arm 60 is completely retracted within the handle 50. The first wheel supporting arm 60 also includes a first wheel retaining means 66 on one end and a first means for extending 68 said first arm 60 on the opposite end thereof. The means for extending 68 the first arm 60 include a first knob 70 which protrudes through the first slot 64. The first knob 70 is slidable within the first slot 64 as the first arm 60 is moved from an outer position to an inner position. A toothed cutting wheel 30 is affixed to the first blade supporting arm 60 by a pin means 72. A second blade supporting arm 80 is cooperatively engaged within the handle 50. The second blade supporting arm 80 is moveable between an outer position wherein the second arm 80 extends through the second passageway 82 and an inner position. The second arm 80 also includes a second blade retaining means 86 and a second means for extending 88 the second arm 84. The second means for extending 88 is slidable within the second slot 84 as the second arm 80 is moved from an outer position to an inner position. A trapezium shaped blade 20 is affixed longitudinally to the second blade supporting arm 80 by a trapezium blade mounting means 92.

METHOD OF USE

As can be readily understood from the above description and the drawings, an advantageous method of using the present invention exists. As described above, the invention includes a handle 12 with a razor cutting blade 20 on one end and a toothed cutting wheel 30 on the other end of the handle 12. The toothed cutting wheel end includes a means 32 for attaching a measuring device 34. The toothed cutting wheel end also has a partition 40 that prevents stored blades from interfering with the toothed cutting wheel 30.

The invention is used in its preferred embodiment by attaching a measuring device 34 to the measuring device receiving means 32. The operator then holds the invention 10 in one hand and the measuring device 34 in the other hand. After measuring the desired length, the handle 12 is moved such that the toothed cutting wheel 30 will cut through the drywall's face paper and score the core of the drywall along the desired cutting distance. The drywall is then snapped back such that rotatable cutting wheel 30 may be used to cut the face paper on the back side of the drywall.

In the second embodiment having a necked handle 50 and a retractable toothed cutting wheel 30, the toothed cutting wheel 30 must first be moved into its outer scoring position. When the measuring device 34 is attached, the method of use is analogous to the method of use for the preferred embodiment.

In light of the above teachings it will be appreciated that several variations of the disclosed embodiments are possible. Those skilled in the art will no doubt be able to utilize the principles of this invention other than as specifically described above. Therefore, it is to be understood that the scope of the invention is to be limited only by the following claims.

I claim:

1. An improved utility knife of the type having:

an elongate handle with first and second opposite ends and a blade receiving slot opening at said first end thereof, said handle having two elongated mating members detachably secured and separable along a longitudinal plane, a carrier reciprocally mounted on one of said elongated members for movement toward and away from said slot opening, a cutting blade supported on said carrier, an elongated tongue rearwardly extending from said carrier for movement thereof, a locking cam surface on the handle defining a plurality of locking abutments for slidably reciprocating the said carrier within said handle;

the improvement comprising:

a toothed cutting wheel affixed to the second end of said handle opposite of said blade-receiving slot opening;

means for receiving and engaging an end of a measuring device, said receiving means including a notch extending substantially coplanar with said toothed cutting wheel.

2. The utility knife of claim 1 wherein said measuring device receiving means further comprises a notch defined in said handle, said notch being superposed to said toothed cutting wheel and being constructed and arranged to selectively receive and engage an end of a measuring tape such that a tape can extend generally perpendicularly from said longitudinal plane.

3. An improved utility knife according to claim 1, further comprising means for storing blades, said blade storing means constructed and arranged between said blade carrier and said toothed cutting wheel.

4. The utility knife of claim 3 further comprising, a partition means between said toothed cutting wheel and said blade holder, said partition means for preventing the blades stored in said blade storing means from contacting said toothed cutting wheel.

5. An improved utility knife of a type having:

a handle having first and second opposite ends with a necked portion therebetween and a blade receiving slot opening at a first end thereof, said handle having two elongated mating members detachably secured and separable along a longitudinal plane extending rearwardly from the slot openings, a carrier reciprocally mounted on one of said elongated members for movement toward and away from said slot openings, a cutting blade supported on said carrier in an elongated tongue rearwardly extending from said carrier for movement thereof, a locking cam surface on the handle defining a plurality of locking abutments for slidably reciprocating the said carrier with said handle;

the improvement comprising:

(a) a toothed cutting wheel affixed to the second end of said necked handle opposite of said blade-receiving slot opening;

(b) means for receiving and engaging an end of a measuring device said receiving means including a notch extending substantially coplanar with said toothed cutting wheel, such that a measuring tape, when engaging said receiving means, will extend generally perpendicularly to said longitudinal plane; said receiving means including a flange superposed to said toothed cutting wheel whereby a measuring device can be received, said flange consists of corresponding notches from said toothed cutting wheel end of each elongated member of said necked handle, said notches when juxtaposed thereby form said flange;

(d) a partition means between said toothed cutting wheel and said blade holder, said partition means for preventing the blades stored in said blade holder from interfering with said toothed cutting wheel.

6. An improved utility knife according to claim 5, further comprising:

(e) a blade holder constructed and arranged between said blade carrier and said toothed cutting wheel.

7. An improved utility knife comprising:

(a) a blade receiving necked handle with an outer wall including first and second ends and having a first and second axis, with a first passageway located at said first end and a first slot located along said first axis and passing through said outer wall, and a second passageway located at said second end and a second slot located parallel to said second axis and passing through said outer wall;

a first tool supporting arm cooperatively engaged within said handle and movable between an outer position wherein said first arm extends through said first passageway, and an inner position wherein said first arm is completely retracted within said handle, said first arm including a blade retaining means on one end and a means for extending said first arm on the opposite end of said first arm, said means for extending said first arm includes a first knob protruding through said first slot and slidable within said first slot as said first arm is moved from said outer position to said inner position;

(c) a toothed cutting wheel affixed to said first tool supporting arm by a pin means;

(d) a second tool supporting arm cooperatively engaged within said handle and moveable between an outer position wherein said second arm extends through said second passageway, and an inner position wherein said second arm is completely retracted within said handle, said second arm including a second blade retaining means and a second means for extending said second arm and slidable within said second slot as said second arm is moved from said outer position to said inner position;

(e) a trapezium-shaped blade affixed longitudinally to said second tool supporting arm;

(f) a trapezium blade mounting means for mounting said blade for retractable, replaceable action of said trapezium-shaped blade within said handle.

8. A scoring device comprising:

(a) a blade receiving necked handle with an outer wall including first and second ends and having a first and second axis, with a first passageway located at said first end and a first slot located along said first axis and passing through said outer wall;

(b) a tool supporting arm cooperatively engaged within said handle and movable between an outer position wherein said arm extends through said first passageway, and an inner position wherein said arm is completely retracted within said handle, said arm including a blade retaining means on one end and means for extending said arm on the opposite end of said arm, said means for extending said arm includes a knob protruding through said first slot and slidable within said first slot as said arm is moved from said outer position to said inner position;

(c) a toothed cutting wheel affixed to said tool supporting arm by a pin means;

(d) means for receiving and engaging an end of a measuring device located at said first end.

9. A method of using a measuring tape and a rotating blade cutting device having:

(a) a necked handle and a blade receiving slot opening at one end thereof, said handle having two elongated members detachably secured and separable along a longitudinal plane extending rearwardly from the slot openings, a carrier reciprocally mounted on one of said elongated members for movement toward and away from said slot openings, a cutting blade supported on said carrier in an elongated tongue rearwardly extending from said carrier for movement thereof, a locking cam surface on the handle defining a plurality of locking abutments for slidably reciprocating the said carrier within said handle, a blade holder at one end of said necked handle opposite to said blade-receiving slot opening;

(b) a toothed cutting wheel;

(c) means for receiving an end of a measuring device (d) a flange; to cut perforateable material; the method comprising:

(1) extending a measuring tape from an edge of the material to the desired distance of the cut;

(2) hooking the end of the measuring tape on said flange;

(3) holding the selected length marking and said tape at the edge of the material with the cutting wheel on said material;

(4) pressing the wheel into the material and guiding the cutting wheel and the tape along the material to cut said material.

* * * * *